US005665693A

United States Patent [19]

Kroner et al.

[11] Patent Number: 5,665,693

[45] Date of Patent: Sep. 9, 1997

[54] USE OF CARBOXYL-CONTAINING REACTION PRODUCTS OF PROTEINS OR PROTEIN HYDROLYZATES IN DETERGENTS AND CLEANERS

[75] Inventors: Matthias Kroner, Eisenberg; Gunnar Schornick, Neuleiningen; Richard Baur, Mutterstadt; Alexander Kud, Eppelsheim; Volker Schwendemann, Neustadt, all of Germany

[73] Assignee: BASF Aktiengesellschaft, Ludwigshafen, Germany

[21] Appl. No.: 530,238

[22] PCT Filed: Mar. 29, 1994

[86] PCT No.: PCT/EP94/00982

§ 371 Date: Oct. 10, 1995

§ 102(e) Date: Oct. 10, 1995

[87] PCT Pub. No.: WO94/24254

PCT Pub. Date: Oct. 27, 1994

[30] Foreign Application Priority Data

Apr. 10, 1993 [DE] Germany ..... 43 11 854.2

[51] Int. Cl.[6] ..... C11D 3/37

[52] U.S. Cl. ..... 510/476; 510/223; 510/230; 510/318; 510/361; 510/434; 510/533

[58] Field of Search ..... 252/174.23, 174.24, 252/DIG. 2, DIG. 15; 510/476, 490, 499, 361, 434, 223, 230, 318, 533

[56] References Cited

U.S. PATENT DOCUMENTS

| | | | |
|---|---|---|---|
| 3,798,180 | 3/1974 | Westernacher | 252/527 |
| 5,207,941 | 5/1993 | Kroner et al. | 252/174.23 |
| 5,408,029 | 4/1995 | Wood et al. | 528/328 |
| 5,442,038 | 8/1995 | Wood et al. | 528/363 |
| 5,496,914 | 3/1996 | Wood et al. | 528/328 |
| 5,519,110 | 5/1996 | Wood et al. | 528/363 |
| 5,521,279 | 5/1996 | Wood et al. | 528/363 |
| 5,527,878 | 6/1996 | Wood et al. | 528/328 |
| 5,552,518 | 9/1996 | Wood et al. | 528/363 |

FOREIGN PATENT DOCUMENTS

| | | |
|---|---|---|
| 0 455 468 | 4/1991 | European Pat. Off. . |
| 1470429 | 6/1969 | Germany . |
| 40 33 209 | 10/1990 | Germany . |
| 4221875 | 1/1994 | Germany . |
| 1-297484 | 11/1989 | Japan . |
| 3-197531 | 8/1991 | Japan . |

OTHER PUBLICATIONS

Zeitschrift Fur Chemie, vol. 25, pp. 18 and 19, 1985.

Derwent abstract accession No. 81-22497D/13, for JP 56012351, Feb. 6, 1981.

*Primary Examiner*—Ardith Hertzog
*Attorney, Agent, or Firm*—Oblon, Spivak, McClelland, Maier & Neustadt, P.C.

[57] ABSTRACT

Use of carboxyl-containing reaction products of (a) maleic anhydride, maleic acid and/or fumaric acid, and (b) proteins or protein hydrolyzates having an acid number of at least 1.5 mmol of NaOH/g of reaction product, as ingredient of reduced-phosphate and phosphate-free detergents and cleaners.

2 Claims, No Drawings

USE OF CARBOXYL-CONTAINING REACTION PRODUCTS OF PROTEINS OR PROTEIN HYDROLYZATES IN DETERGENTS AND CLEANERS

DISCUSSION OF THE BACKGROUND

1. Field of the Invention

The present invention relates to the use of carboxyl-containing reaction products of proteins or protein hydrolyzates which have been hydrolyzed no further than the dipeptide stage as ingredient of detergents and cleaners.

2. Discussion of the Background

Z. Chem. 25 (1985), 18–19, discloses the reaction of amino acids or peptides with maleic anhydride in acetic acid.

JP-A-56/012 351 discloses reaction products of amino acids and maleic anhydride or succinic anhydride, which are prepared in organic solvents. The reaction products are used for example in shampoos or cleaners.

EP-A 0 455 468 discloses detergent formulations which contain chemically modified vegetable proteins as grayness inhibitor. The proteins are preferably modified by reaction with phthalic anhydride in an aqueous medium at a pH of at least 8. However, the degree of the modification of the proteins is relatively small, so that the reaction products have virtually no dispersing effect and do not enhance the primary detergency when used in detergents.

DE-A-4 033 209 describes the reaction of protein hydrolyzates having a molecular weight of from 200 to 20,000 with ether carbonyl chlorides in an aqueous medium. The reaction products are used as surfactants in detergents and cleaners.

EP-A--0457205 discloses the use of water-soluble or water-dispersible grafted proteins as ingredient of detergents and cleaners in amounts from 0.1 to 20% by weight, based on the respective formulations. The grafted proteins are prepared by free-radically initiated copolymerization of monoethylenically unsaturated monomers in the presence of proteins.

SUMMARY OF THE INVENTION

It is an object of the present invention to provide dispersing additives for use in reduced-phosphate and phosphate-free detergents and cleaners.

We have found that this object is achieved according to the invention by the use of carboxyl-containing reaction products obtainable by reaction of (a) maleic anhydride, maleic acid and/or fumaric acid, and (b) proteins or protein hydrolyzates not hydrolyzed further than the dipeptide stage, at temperatures from 120° to 300° C. under superatmospheric pressure in the absence of free-radical initiators, an aqueous medium and an organic solvent to form reaction products having an acid number of at least 1.5 mmol of sodium hydroxide/g of reaction product, as ingredient of reduced-phosphate and phosphate-free detergents and cleaners.

DETAILED DESCRIPTION OF THE PREFERRED EMBODIMENTS

The reaction products are prepared using as component a) maleic anhydride, maleic acid, fumaric acid or mixtures thereof. Preference is given to using maleic anhydride.

Suitable compounds for use as compounds of component b) are proteins or protein hydrolyzates which have not been hydrolyzed further than the dipeptide stage. Usable proteins include all synthetic or natural proteins and also mixtures of synthetic and natural proteins. The proteins can be of vegetable or animal origin. The proteins can be used in purified form or unpurified to prepare the reaction products. An example of a purified protein is soybean protein isolate, while whey protein is an example of an unpurified protein. Examples of animal proteins are caseine, whey, gelatin and bone glue. Examples of vegetable proteins are the proteins of potatoes, sugar beet, marrowfat peas, soybean, wheat and corn (maize).

The protein hydrolyzates are prepared by hydrolysis of the proteins under acid, neutral, basic or fermentative conditions. The hydrolysis of the proteins can be carried on to different extents, but not further than the dipeptide stage. The hydrolysis products may additionally contain portions of low molecular weight peptides. Component b) may also comprise mixtures of proteins and protein hydrolyzates. Examples of acid-, neutral- or base-hydrolyzed proteins are bone glue, soybean hydrolyzates and wheat hydrolyzates. However, the proteins can also be treated reductively or oxidatively to convert them into a more water-soluble form. For example, wheat gluten or soybean proteins can be reductively pretreated by means of alkali metal sulfite, alkali metal thiosulfate, mercaptoethanol, thioglycolic acid, thiolactic acid or alkali metal sulfide. They can also be treated with oxidizing agents, for example with hydrogen peroxide, peracetic acid, peroxides, sodium peroxodisulfate, potassium peroxodisulfate, oxygen or nitric acid.

The natural proteins may by virtue of their origin also contain other constituents such as carbohydrates, fiber constituents, cellulose and hemicellulose, oils or fats. For example, whey proteins contain major quantities of lactose and other carbohydrates as well as minor amounts of milk fat and oil. Soybean milk may contain oils and fats from the soybean plant as well as the soybean proteins. Similarly, celluloses may be present in the soybean protein. The proteins can be reduced/hydrolyzed in molecular weight to such an extent that di- and tripeptides are present besides higher molecular weight protein hydrolyzates. Examples of dipeptides are:

Asp-Glu
Asp-Asp
Asp-Gly

Examples of tripeptides are:

Asp-Asp-Asp
Asp-Glu-Asp
Asn-Gln-Ser
Glu-Ser-Pro
Asp-Ser-Pro
Asp-Glu-Gly
Asp-Lys-Asn

The abbreviations used above have the following meanings:

Asp: aspartic acid
Glu: glutamic acid
Gly: glycine
Asn: asparagine
Gln: glutamine
Ser: serine
Pro: proline
Lys: lysine Examples of synthetic proteins are polyaspartic acids which are obtainable for example by polycondensation of L- or DL-aspartic acid or by thermal polycondensation of acid ammonium salts of fumaric acid, maleic acid or malic acid. Polycondensates of glutamic acid which are preparable by polymerization of N-carboxylic anhydrides of glutamic acid and its esters. Suitable for use as component b) are all synthetic peptides obtainable by polymerization of N-carboxylic anhydrides in the manner of an anionic polymerization. Suitable for use as component b) are also those synthetic peptides which are obtainable copolymerization of various N-carboxylic anhydrides of different amino acids.

Component b) preferably comprises proteins of soybean, wheat, potatoes, whey, casein and gelatin.

Reaction of component a) with b) increases the acid number of the proteins. The acid number is the amount of sodium hydroxide solution required to neutralize 1 g of the reaction product. It is determined for example by titration by 0.1N sodium hydroxide solution. The acid numbers of the proteins vary from 0 to 1, while the acid numbers of the reaction products are at least 1.5 mmol of sodium hydroxide solution/g of reaction product. The acid numbers of the hydrolyzed proteins can be up to 1.3 mmol of sodium hydroxide solution/g. They are further increased by the reaction of the protein hydrolyzates with the compounds of component a). The acid numbers of the reaction products are preferably 1.8-10 mmol of sodium hydroxide solution/g of reaction product.

The compounds of components a) and b) are reacted at temperatures within the range of 90–300. The reaction is carried out in particular at temperatures from 120° to 300° C., preferably from 150° to 270° C., under superatmospheric pressure, for example at up to 30 bar. The compounds of component a) can be used in the reaction as solvents for the proteins or protein hydrolyzates. The reaction of components a) and b) is preferably carried out in the absence of water. Particular preference is given to a procedure where the reaction is carried out in molten maleic anhydride. Components a) and b) can be reacted with each other in any desired weight ratio, for example in a weight ratio of from 99:1 to 1:99. Preference is given to using components a) in excess; for example, their proportion in the reaction mixture is 55–90% by weight. Excess component a) can easily be removed from the reaction mixture after the reaction has ended. Using for example maleic anhydride as component a), it can be easily removed from the reaction mixture by sublimation, distillation or extraction with solvents, such as acetone or ethyl acetate.

The reaction products of components a) and b) have K values (determined by the method of Fikentscher in 1% strength aqueous solution on the sodium salt at pH 7 and 25° C.) from 10 to 100.

The reaction products can be used in the form of the free acids or in the form of the salts with alkali metal, alkaline earth metal and ammonium bases. The salts are customarily prepared by adding a base or a mixture of a plurality of bases to an aqueous solution or slurry of the reaction products in water. Suitable bases are for example sodium hydroxide solution, potassium hydroxide solution, sodium carbonate, potassium carbonate, sodium bicarbonate, potassium bicarbonate, calcium hydroxide, calcium oxide, barium hydroxide, magnesium hydroxide or magnesium oxide and also ammonia and amines such as methylamine, ethylamine, n-propylamine, isopropylamine, n-butylamine, isobutylamine, ethanolamine, diethanolamine, triethanolamine, morpholine and cyclohexylamine.

The reaction products of components a) and b) are biodegradable according to the OECD Guidelines for Testing of Chemicals, Paris 1981, 302 B (modified Zahn-Wellens test). They are also degradable judging by the decrease in the dissolved oxygen in the closed bottle test and judging by the modified SCAS test, cf. R. Wagner, Methoden zur Prüfung der biochemischen Abbaubarkeit chemischer Substanzen, Verlag Chemie, Weinheim 1988, page 62.

The above-described reaction products or their alkali metal, ammonium and alkaline earth metal salts are used as ingredient of reduced-phosphate or phosphate-free detergents and cleaners. In most cases the amount of the reaction products used is 0.1–30% by weight, based on the detergent or cleaner. Reduced-phosphate detergents for the purposes of the present invention are formulations which contain not more than 25% by weight of phosphate, calculated as sodium triphosphate. Phosphate-free detergents mostly contain sodium aluminum silicate (zeolite A). The reaction products of components a) and b), or their salts, are preferably used in amounts from 1 to 20% by weight, based on the detergent or cleaner formulation. As used herein, cleaner formulation comprehends all cleaners for hard surfaces, for example ware cleaners, cleaners for industrial bottlewashing, cleaners for dairy plants and floor cleaners.

The reaction products are preferably used in laundry detergents. In the wash liquor they show good dispersing power for particulate soil, in particular for clay minerals. This property is important because clayey laundry soils occur widely. The reaction products also act as detergent builders and function during the wash to reduce the encrustation and the graying of the washed fabric. They are thus also suitable for use as encrustation and grayness inhibitors.

The composition of detergent and cleaner formulations can vary greatly. Detergents and cleaners customarily contain from 2 to 50% by weight of surfactants with or without builders. These figures apply not only to liquid but also to pulverulent detergents and cleaners. Examples of the compositions of detergent formulations customary in Europe, the U.S. an Japan are found for example in table form in Chemical and Engn. News, 67 (1989), 35. Further information about the compositions of detergents and cleaners can be found in WO-A-90/13581 and also Ullmann's Encyklopädie der technischen Chemie, Verlag Chemie, Weinheim 1983, 4th edition, pages 63–160. Also of interest are those detergent formulations which contain up to 60% by weight of an alkali metal silicate and up to 10% by weight of a polycondensate according to the present invention. Suitable alkali metal silicates include for example the amorphous sodium disilicates which are described in EP-A--0 444 415 and also crystalline sheet-silicates which according to EP-A--0 337 219 are present as builders in detergent formulations and according to EP-B--0 164 514 are used for softening water, and sodium silicates obtainable by dewatering sodium silicate solutions and drying down to water contents of from 15 to 23, preferably from 18 to 20, % by weight. Sodium aluminum silicates (zeolite A) can be present in detergents in amounts of up to 50%.

The detergents may additionally contain a bleaching agent, for example sodium perborate, which if used can be present in the detergent formulation in amounts of up to 30% by weight. The detergents and cleaners may include further customary additives, for example complexing agents, citrates, opacifiers, optical brighteners, enzymes, perfume oils, color transfer inhibitors, grayness inhibitors and/or bleach activators.

The reaction products are also suitable for use as water treatment agents. For this purpose, they are customarily added to the water in cooling cycles, evaporators or desalination plants in amounts from 1 to 1,000 ppm. They also act as scale inhibitors in the evaporation of sugar juice. They are added to the thin sugar liquor in amounts from 0.1 to 1,000 ppm.

The K values of the neutralized reaction products were determined by the method of H. Fikentscher, Cellulose-Chemie, 13 (1932) 58–64, 71–74, at pH 7 and 25° C. on 1% by weight aqueous solutions of the sodium salts of the polymers.

EXAMPLES

General method for preparing the reaction products

A 500 ml capacity reactor which can be sealed pressure-tight and which is equipped with a stirrer is charged with the amounts of maleic anhydride and protein indicated in Table 1 and heated to a temperature of 140° C. under superatmospheric pressure in the absence of moisture for 4 h. The result is a solution or suspension of the reaction product in the molten maleic anhydride. To purify the reaction mixture, 1 l of anhydrous acetone is added after the reaction mixture has cooled down, the mixture is stirred for 3 h and filtered. The filter residue is then extracted in an extractor with acetone for 4 h and thereafter dried under reduced pressure. This affords the reaction products indicated in Table 1, which are characterized in terms of the K value and the acid number.

TABLE 1

| Reaction product No. | (a) Maleic anhydride [g] | (b) Protein [g] | Acid number [mmol of NaOH/g] | Reaction product [g] | K value | Acid number [mmol NaOH/g] |
|---|---|---|---|---|---|---|
| 1 | 200 | 40 Soybean concentrate 1 (Unico HS) | 0.2 | 49.7 | 18.9 | 2.8 |
| 2 | 200 | 40 Soybean concentrate 2 (Unico AH) | 0.3 | 47.5 | 60.3 | 2.9 |
| 3 | 400 | 80 Soybean protein isolate | — | 93.2 | 21.1 | 2.7 |
| 4 | 400 | 100 Soybean milk powder | 0.1 | 81 | 26.5 | 2.9 |
| 5 | 400 | 80 Caseine | 0.5 | 102 | 30.1 | 2.7 |
| 6 | 400 | 200 Whey powder | 0.2 | 318.5+) | 11.9 | 5.5 |
| 7 | 400 | 100 Wheat gluten | 0.4 | 102 | 69.3 | 2.2 |
| 8 | 400 | 100 Gelatin | — | 123 | 23.9 | 2.8 |
| 9 | 400 | 250 Gelatin | — | 285 | — | 2.6 |
| 10 | 400 | 100 Bone glue | — | 100 | 26.6 | 2.6 |

+)The filter residue was extracted with ethyl acetate

Reaction products 1 to 10 were converted into the sodium salts for the application tests by suspending 10 g of the pulverulent products in 100 ml of water and adding 10% strength aqueous sodium hydroxide solution until no more sodium hydroxide solution was consumed and an aqueous solution or a suspension of the reaction products having a pH of from 7 to 8 had been formed.

Application examples

The clay dispersing power was assessed by the following clay dispersion (CD) test.

CD test

Particulate soil is modeled with finely ground china clay SPS 151.1 g of the clay is intensively dispersed for 10 minutes in 98 ml of water in a 100 ml cylinder in the presence of 1 ml of a 0.1% strength sodium salt solution of the polyelectrolyte. Immediately after stirring has been stopped, a sample of 2.5 ml is removed from the center of the cylinder and diluted to 25 ml and measured in a turbidimeter. After the dispersion has stood for 30 and 60 minutes, further samples are taken and again measured in the turbidimeter. The turbidity of the dispersion is reported in nephelometric turbidity units (NTUs). The less the dispersion settles on storage, the higher the measured turbidity values are and the stabler the dispersion is. The second physical parameter determined is the dispersion constant $\tau$, which describes the time course of the sedimentation process. Since the sedimentation process approximates to a monoexponential time law, $\tau$ indicates the time within which the turbidity decreases to 1/e-th of the original level at time t=0.

The higher the value of $\tau$, the slower the rate of sedimentation in the dispersion.

TABLE 2

| Example No. | Reaction product No. | CD test turbidity in NTUs t = 0 | t = 30 [min] | t = 60 | $\tau$ [min] |
|---|---|---|---|---|---|
| 1 | 1 | 760 | 590 | 520 | 172.0 |
| 2 | 2 | 790 | 630 | 580 | 237.4 |
| 3 | 3 | 790 | 610 | 540 | 174.3 |
| 4 | 4 | 790 | 620 | 550 | 181.0 |
| 5 | 5 | 790 | 620 | 560 | 201.0 |
| 6 | 6 | 780 | 610 | 550 | 197.7 |
| 7 | 7 | 780 | 620 | 540 | 170.0 |
| 8 | 8 | 780 | 630 | 560 | 192.9 |
| 9 | 10 | 770 | 610 | 530 | 167.2 |
| Comparative Example 1 | without polymer | 600 | 37 | 33 | 41.4 |
| Comparative Example 2 | citric acid | 740 | 590 | 510 | 165.9 |

Test of primary detergency

The specific aspect of the ability to detach clay from textile fabric was investigated by means of washing trials. The clay-detaching power (CDP) test described below shows the principal clay-detaching power of an additive in the presence of a surfactant, but in the absence of other, customary detergent ingredients, and is accordingly independent of the detergent formulation chosen. Clay minerals are colored and, deposited on the fabric, cover it in a colored haze. To test the primary detergency in respect of clay on a fabric, a cotton/polyester fabric was uniformly coated with a clay mixture consisting of 33.3% of each of the grades 178/R (ocher), 262 (brown) and 84/rf (brownish red) from Carl Jäger, Hilgert. The different grades of clay differ in "fatness", i.e. in the level of aluminum oxide, iron oxide and manganese oxide they contain. The clay mixture was homogeneously applied to the fabric in the form of a 20% strength suspension in fully demineralized water by vigorous recirculation of the suspension in a jigger from Küsters, Krefeld, at 10 meters/min using a twill consisting of 33% of cotton and 67% of polyester (Co/PES) from Winkler, Waldshut. After 3 passes the fabric was rinsed once with 600 l of fully demineralized water. Thereafter the wet fabric was dried in a tenter at 50° C. at a speed of 2 meters/min. The clayey fabric produced in this way contains 1.76% of clay, determined by ashing at 700° C. for 2.5 h.

The fabric thus obtained is premeasured via color strength and divided into classes. The color strength range of a class is arbitrarily set at 10 units. The color strength range of all classes ranges from 260 to 340 color strength units for the blend fabric used. A wash series, consisting of 6 wash trials, is carried out with soiled fabric from only one class.

The washing trials (CDP) were carried out under the following conditions:

| | |
|---|---|
| Washing machine: | Launder-o-meter |
| Number of wash cycles: | 1 |
| Number of rinse cycles: | 1 |
| Number of washing trials: | 6 |
| Wash temperature: | 20–24° C. |
| Washing time: | 15 min |
| Liquor quantity: | 500 g of FD[1] water + 80 ppm of ethoxylated oxo process alcohol ($C_{13}/C_{15}$ oxoalcohol + 8 EO) |
| Water hardness ($Ca^{2+}$ + $Mg^{2+}$): | 1 mmol/l |
| Molar ratio of $Ca^{2+}$:$Mg^{2+}$:$HCO_3^-$: | 3:1:6 |
| pH: | 10 ± 0.1 |
| Test concentration of polymer: | 80 ppm |
| Soil fabric: | 5 g of clayey fabric (–30,5 cm × 8 cm) |
| White or clean fabric: | 5 g of PES/Co fabric (–30 cm × 8 cm) |

[1]FD = fully demineralized

After rinsing with 500 g of water (hardness 1 mmol/l of $Ca^{2+}$ and $Mg^{2+}$), 20° C., 1 min, in the Launder-o-meter, the fabrics were hydroextracted and individually hung up to dry. The fabrics were measured with an Elrepho 2000 from Data Color, Heidenheim, at 6 points per piece. The wavelength range used for evaluation was 400–700 nm. The quantity measured was the degree of reflectance as a function of the wavelength. The reference used was barium sulfate. The reflectance values are used to calculate the color strength as weighted for the sensitivity of the eye, according to W. Baumann, R. Broßmann, B. T. Gröbel, N. Kleinemeier, M. Kraver, A. t. Leaver and H.-P. Oesch; Melliand Textilberichte 67 (1986), 562 ff. The weighting factors for the eye sensitivity function ($\bar{X}_{10}(\lambda)+\bar{Y}_{10}(\lambda)+\bar{Z}_{10}(\lambda)$) are discernible from the following table:

| λ (nm) | Weighting factors ($\bar{X}_{10}(\lambda) + \bar{Y}_{10}(\lambda) + \bar{Z}_{10}(\lambda)$) |
|---|---|
| 400 | 0.1071 |
| 420 | 1.1984 |
| 440 | 2.4131 |
| 460 | 2.1759 |
| 480 | 1.1062 |
| 500 | 0.6831 |
| 520 | 0.9402 |
| 540 | 1.3525 |
| 560 | 1.7025 |
| 580 | 1.8831 |

-continued

| λ (nm) | Weighting factors ($\bar{X}_{10}(\lambda) + \bar{Y}_{10}(\lambda) + \bar{Z}_{10}(\lambda)$) |
|---|---|
| 600 | 1.7823 |
| 620 | 1.2544 |
| 640 | 0.6114 |
| 660 | 0.2129 |
| 680 | 0.0568 |
| 700 | 0.0133 |

The weighting with the eye sensitivity function of man is intended to give more weight to even slight yellowing of the fabric. The precise derivation of the mathematical evaluation was described by A. Kud in Tenside, Surfactants, Detergents, 28 (1981) 497.

The primary detergency in % is calculated according to the following equation:

$$P=(f_{s,b}31\ f_{s,a})/(f_{s,b}-f_{s,o})\cdot 100$$

$f_{s,b}$=color strength of soiled fabric (clayey fabric) prior to washing $f_{s,a}$=color strength of soiled fabric after washing $f_{s,o}$=color strength of clean fabric prior to soiling (soil fabric prior to soiling).

The use of the color strength for calculating the primary detergency instead of the reflectance at a single wavelength or the K/S values (K=absorption coefficient and S=scattering coefficient) at a single wavelength as done in the literature has the advantage of covering the visible region of the spectrum and of including soil particles in any color.

The polymers to be used according to the present invention were tested by the above-described CDP test; cf. Examples 10 to 18. The results obtained are indicated in Table 3 together with the results of the below-described Comparative Examples 3 and 4. It is evident that addition of the polymers to be used according to the present invention to the aqueous solution of the nonionic surfactant brings about an enhancement in the primary detergency.

Comparative Example 3

Instead of the reaction products used in Examples 10 to 18, the same amount, i.e. 80 ppm, of citric acid in the form of the mono-sodium salt was used.

Comparative Example 4

Example 10 was repeated with the sole exception that the test was carried out in the absence of reaction product 1, to test the effect of a surfactant solution which contained 80 ppm of the surfactant used in Examples 10 to 18.

TABLE 3

| Example No. | Reaction product No. | Effect [%] in test on clay-detaching power |
|---|---|---|
| 10 | 1 | 62.0 |
| 11 | 2 | 62.7 |
| 12 | 3 | 64.5 |
| 13 | 4 | 61.1 |
| 14 | 5 | 65.0 |
| 15 | 6 | 60.0 |
| 16 | 7 | 59.2 |
| 17 | 8 | 56.4 |
| 18 | 10 | 58.1 |

TABLE 3-continued

| | Reaction product No. | Effect [%] in test on clay-detaching power |
|---|---|---|
| Comparative Example | | |
| 3 | — | 55.3 |
| 4 | — | 55.3 |

We claim:

1. A reduced-phosphate or phosphate-free detergent or cleaner comprising carboxyl-containing reaction products obtained by reaction of (a) at least one monomer selected from the group consisting of maleic anhydride, maleic acid and fumaric acid, and (b) proteins or protein hydrolyzates not hydrolyzed further than the dipeptide stage, at temperatures from 120° to 300° C. under superatmospheric pressure in the absence of free-radical initiators, an aqueous medium and an organic solvent to form reaction products having an acid of at least 1.5 mmol of NaOH/g of reaction product.

2. The reduced-phosphate or phosphate-free detergent or cleaner as claimed in claim 1, wherein component (a) is maleic anhydride.

* * * * *